United States Patent [19]

Johansen

[11] Patent Number: 4,899,886

[45] Date of Patent: Feb. 13, 1990

[54] CARD BOX FOR DISPENSING AND DISPLAYING CARDS

[75] Inventor: Norman A. Johansen, North Ridgeville, Ohio

[73] Assignee: The Sherwin-Williams Company, Cleveland, Ohio

[21] Appl. No.: 293,151

[22] Filed: Dec. 30, 1988

[51] Int. Cl.[4] ..... A45C 11/18

[52] U.S. Cl. ..... 206/555; 206/39.4; 206/39.5; 206/39.6; 206/804; 222/180; 222/132; 222/279; 222/283; 222/305

[58] Field of Search ..... 206/39, 39.4, 39.5, 206/39.6, 425, 555, 804; 222/180, 181, 132; 221/31, 63, 279, 280, 283, 303, 305

[56] References Cited

U.S. PATENT DOCUMENTS

| | | | |
|---|---|---|---|
| 292,789 | 2/1884 | Burdick | 206/39.5 |
| 340,355 | 4/1886 | Ramser | 221/280 |
| 417,166 | 12/1889 | Geisenheimer | 206/39.4 |
| 550,020 | 11/1895 | Hughes | 221/283 |
| 787,452 | 4/1905 | Johnson | 206/39.5 |
| 841,266 | 1/1907 | Northup | 206/81 |
| 912,110 | 2/1909 | Gill | 206/39.5 |
| 912,804 | 2/1909 | Brush . | |
| 1,040,051 | 10/1912 | Swihart | 206/39.5 |
| 1,537,244 | 5/1925 | McCaghren | 206/39 |
| 1,704,675 | 3/1929 | Barta | 206/81 |
| 3,078,016 | 2/1963 | Judy | 222/181 |
| 3,189,219 | 6/1965 | Holzworth et al. | 221/280 |
| 3,268,120 | 8/1966 | Durst | 222/181 |
| 3,463,309 | 8/1969 | Szostek | 206/470 |
| 3,710,929 | 1/1973 | Morales | 206/39.5 |
| 4,287,921 | 9/1981 | Sanford | 221/181 |
| 4,336,894 | 6/1982 | Crye et al. | 221/280 |
| 4,382,526 | 5/1983 | Stone | 221/305 |
| 4,569,462 | 2/1986 | Belokin | 222/180 |
| 4,586,631 | 5/1986 | Loder | 221/58 |
| 4,592,486 | 6/1986 | Belokin | 221/283 |

*Primary Examiner*—David T. Fidei

*Attorney, Agent, or Firm*—Robert E. McDonald; Steven W. Tan

[57] ABSTRACT

A package for displaying and dispensing cards, including a front panel and a rear panel forming a recess therebetween in which cards may be placed. The front panel has an opening therein through which the cards may be seen and through which a finger may touch and push on the card. A resilient biasing means is placed in the recess at a position between the cards firmly in the recess. A cam surface is formed along the edge of the recess with the opening so that when the card is pushed toward the opening, a single card engages the cam surface and part of it moves out of the recess so that it may be readily grasped and removed from the recess.

10 Claims, 2 Drawing Sheets

CARD BOX FOR DISPENSING AND DISPLAYING CARDS

BACKGROUND OF THE INVENTION

People who are in the market for paint often need a sample of the color to compare it with other furnishings. Accordingly, it is important to be able to display and dispense color cards in a paint store for customers. The color card dispensers of the prior art had the inherent problems of not being able to be readily seen or of not being easily removable from the containers. Moreover, prior art packages such as shown in U.S. Pat. Nos. 3,463,309 and 1,704,675, which are incorporated herein by reference, did not allow the user to readily grasp a single color card and remove it from the dispenser. The prior art devices also had the deficiency of enabling the user to grasp many cards at one time and remove them.

In the present invention, a dispensing package has been designed which particularly allows for displaying a series of different-colored cards in dispensers which are mounted in a package holder. Each of the dispensing packages has a series of one-color sample cards located in it, and each is so designed that a person need only push on one of the cards to partially remove it from the dispenser. The person may then simply grasp the individual card and remove it while the remaining color cards stay exactly in the position in the dispenser for which they were designed. Moreover, the next color card is displayed for a subsequent potential customer.

In order to accomplish the results of readily displaying and dispensing different color cards, a dispensing package has been designed which includes a front panel and a back panel interfitted so that they form a recess therebetween. The front panel has an opening across its width of the front surface and has a top, bottom, and sides operatively connected to form a boxlike aperture. It also has a top and bottom flange. The bottom flange is hingedly connected to the back panel. A compartment in the back panel encloses a resilient biasing member such as a polymeric foam or a metal or plastic spring which acts against the color cards in the recess forcing the color cards towards the front panel. The back panel also has a bottom, sides, and top portion, along with an upper and lower flange. The top portion includes an upwardly and outwardly directed cam surface which fits through the opening in the front panel. The front panel and back panel are so sized that they interfit closely.

As a result of the structure of this invention, the user would insert a finger (normally, a thumb) in an opening in the front panel and push the color card toward the cam surface. A single color card would thus be moved toward the cam surface. The top edge of the color card would engage the cam surface and move through the opening in the front panel. The remaining color cards would be located in their present position and would still be biased and held in compression by the biasing member in the back panel. The use of this invention prevents the former fumbling for cards which were difficult to grasp and pull from their containers. This invention also prevents inadvertently grasping a multiplicity of cards.

The use of this invention provides for the efficient display and dispensing of color cards or other materials which has heretofore been unknown.

SUMMARY OF THE INVENTION

This invention relates to a package for displaying and dispensing paper materials, such as color cards, promotional materials and the like. The package includes a front panel and rear panel forming a recess therebetween. Color cards or other paper materials are placed in the recess. A front panel, which preferably will be transparent, has an opening through which the cards may be seen and through which a finger may touch and push on the card. A resilient biasing means in the recess is positioned between the cards and one of the panels in order to hold the cards firmly in the recess. A cam surface is placed along one edge of the recess near an opening in the front panel so that when a card is pushed toward the opening, the top edge of the card engages the cam surface and moves through the opening so that it may be readily grasped and removed.

DETAILED DESCRIPTION OF THE DRAWINGS

Figure 1:
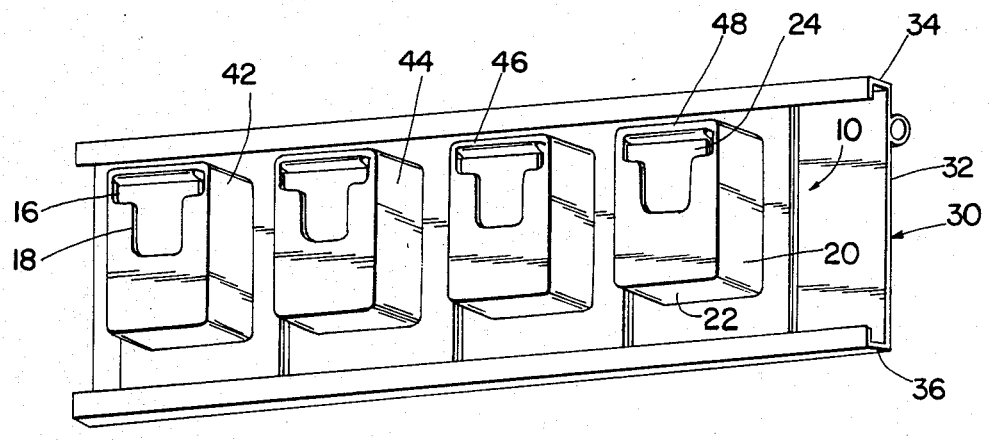
FIG. 1 illustrates a series of dispensing packages.
Figure 2:
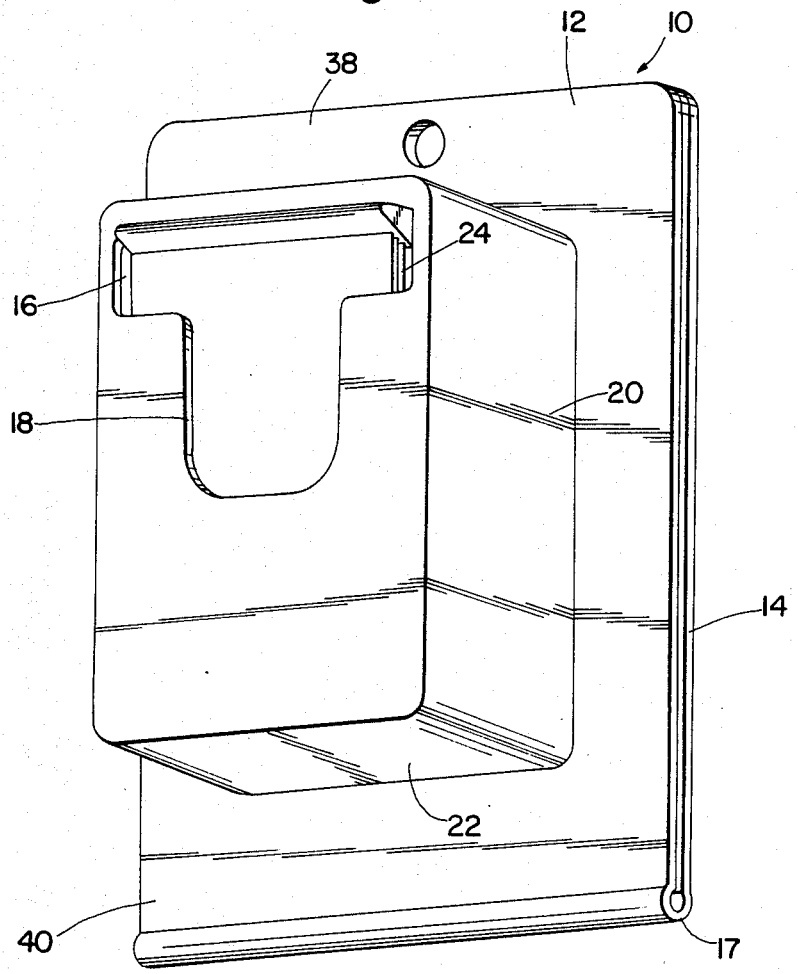
FIG. 2 is a perspective view of a single dispensing package.

As illustrated in FIGS. 1 and 2, a dispensing package 10 includes a front panel 12 and a back rear panel 14 which are hingedly connected along their bottom edges 17. The front panel 12 usually is a transparent thermoplastic material and has an opening 16 across the width of the front panel and has a U-shaped portion 18 which projects downwardly. A top surface (not shown), side 20, and bottom 22 are operatively attached in order to form a boxlike container in which color cards 24 may be placed.

A package holder 30 has a back 32, a top channel 34, and a bottom channel 36 through which top flange 38 and bottom flange 40 may be held in position. As particularly illustrated in FIG. 1, a plurality of dispensing packages 42, 44, 46, and 48 are located in order to be utilized in displaying different color cards.

Figure 3:
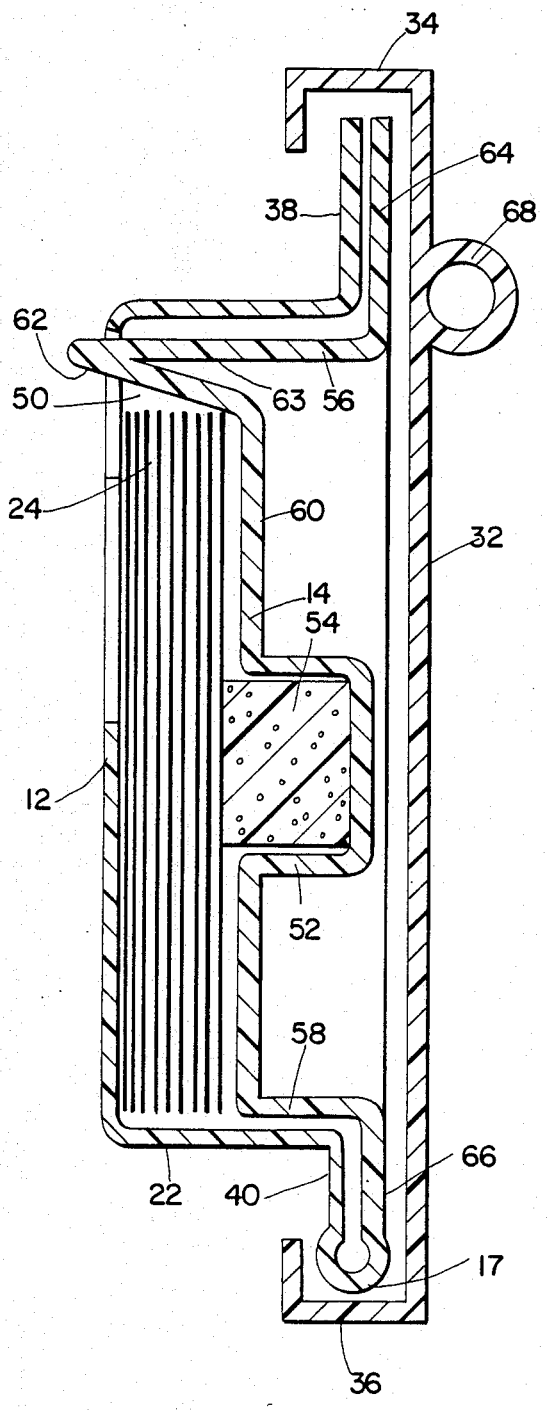
FIG. 3 is a cross-sectional view of the dispensing package of this invention.
Figure 4:
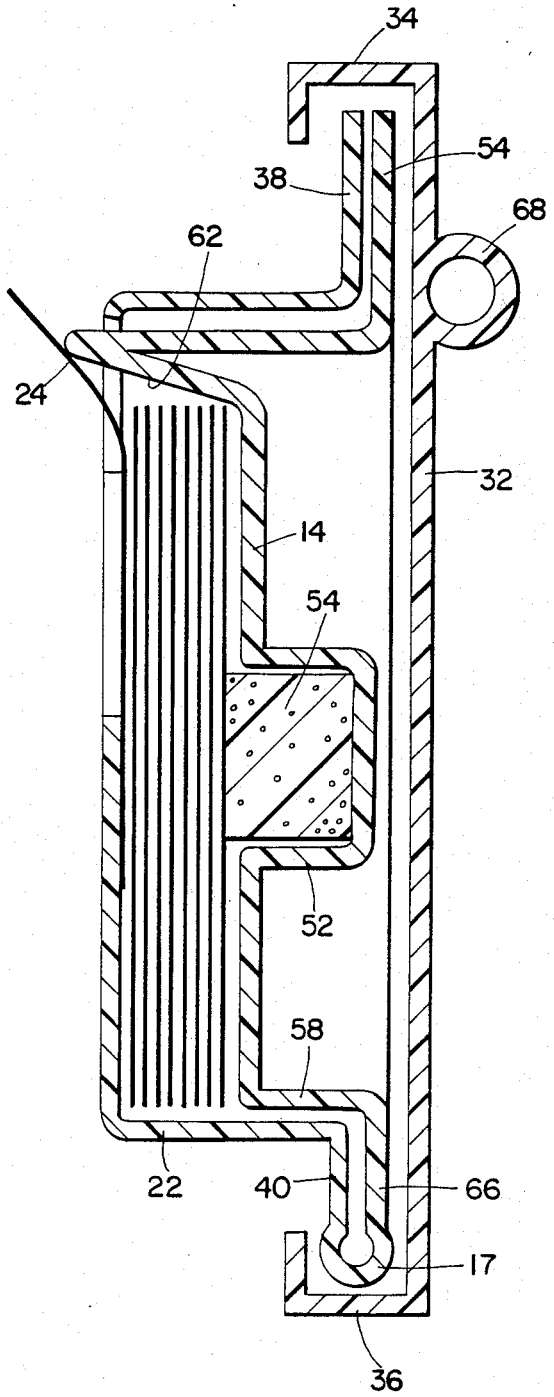
FIG. 4 is a cross-sectional view of the dispensing package of this invention wherein one of the color cards is removed.

As particularly noted in FIGS. 3 and 4, the front panel 12 and the back panel 14 form a recess 50 in which the color cards are located. The back panel further includes a compartment 52 having a back and a top, bottom and sides holding a resilient biasing means such as the polymeric foam 54 which is readily compressible. The foam or other resilient means 54 is dimensioned so that its depth is greater than the depth of the compartment 52. When the cards 24 are placed in the recess 50, they compress the foam, thus holding the cards in compression against the front panel 12 and making them readily available through the openings 16 and 18.

The back panel 14 has a top portion 56, bottom 58, and a rear portion 60. The top portion 56 includes an upwardly and outwardly extending cam surface 62 which projects outwardly through the front panel 12. The other portion of the top portion 56 includes a horizontal member 63. The size of the back panel is such that it interfits closely inside the front panel along the top, bottom, and sides. The back panel also has an upwardly extending flanges 64 and downwardly extending flanges 66.

The upwardly extending flanges 38 and 64, respectively, of the front and back panels, and the downwardly extending flanges 40 and 66 engage channels 34 and 36, respectively, of the package holder. The channels are shown in the general shape, and the other shapes will be obvious to those skilled in the art. A channel 68 on the back 32 forms an aperture through which a rod may be placed to suspend the package holder.

In use, it is only necessary for the user to place a thumb, finger, or implement through the opening 18 against the cards 24 and push toward the cam surface, as illustrated in FIGS. 3 and 4. When this is done, the outwardmost color card 24 slips over the other second color card and moves against the cam surface 62. As it does so, the color card bends outwardly at the disposal of the user so that it may be removed from the dispenser. During the removal process, the remaining color cards move forward because of the foam 54 pressing against them.

As can be seen herein, the design of this dispensing package makes the removal of more than one card at a time inconvenient.

What is claimed is:

1. A package for displaying and dispensing cards, comprising:

a front panel and a back panel forming a recess therebetween in which cards may be placed, the front panel having an opening therein through which the cards may be seen and through which a finger may touch and push on the card;

a resilient biasing means in the recess positioned between the cards and one of the panels in order to hold the card firmly in the recess;

a cam surface along the edge of the recess and projecting through the opening in the front panel so that when a card is to be pushed toward the opening, the card engages the cam surface and part of the card moves out of the recess so that the card may be readily grasped and removed from the recess.

2. The package of claim 1, wherein the biasing means is a section of elastic polymeric foam that is compressed by the cards in the recess.

3. The package of claim 1, wherein the cam surface is part of the back panel.

4. The package of claim 3, wherein the back panel comprises a rear surface which contains a compartment for holding the resilient biasing means, a top portion that includes the cam surface, sides, and a bottom portion.

5. The package of claim 4, wherein the front panel has a top, bottom, sides, and front which are operatively connected and dimensioned to fit over the back panel.

6. The package of claim 5, wherein the opening in the front panel is generally across the front panel and the cam surface in the back panel projects therethrough so that the upper portion of the recess is the cam surface which tapers upwardly and outwardly through the opening in the front panel.

7. A package for displaying and dispensing cards, comprising:

a front panel and a back panel forming a recess therebetween in which cards may be placed, the front panel having an opening therein through which the cards may be seen and through which a finger may touch and push on the card;

a polymeric foam resilient biasing means in the recess positioned between the cards and one of the panels in order to hold the cards firmly in the recess;

a cam surface along the edge of the recess and projecting through the opening in the front panel so that when a card is to be pushed toward the opening, the card engages the cam surface and part of the card moves out of the recess so that the card may be readily grasped and removed from the recess;

wherein the front panel has a top, bottom, sides and front which are operatively connected and dimensioned to fit over the back panel; and wherein the top of the front panel has a downwardly extending lip which engages the top of the back panel and holds the front and back panels together; and wherein the back panel comprises a rear surface which contains a compartment for holding the resilient biasing means, a top portion that includes the cam surface, sides and a bottom portion; and wherein the opening in the front panel is generally across the front panel and the cam surface in the back panel projects therethrough so that the upper portion of the recess is the cam surface which tapers upwardly and outwardly through the opening in the front panel.

8. The package of claim 7, wherein the opening in the front panel has a downwardly extending U-shaped portion which exposes a portion of the card which can be touched and pushed against the cam surface.

9. The package of claim 8, wherein the package has an upwardly extending flange and a downwardly extending flange which engage a package holder, the package holder including a back portion and an upper and lower channel which hold the upper and lower flanges so that the package may be held therein.

10. The package of claim 9, wherein the package holder is wide enough to hold at least two packages.

* * * * *